US005848851A

United States Patent [19]

Gunasekera

[11] Patent Number: 5,848,851

[45] Date of Patent: Dec. 15, 1998

[54] COVER HOLDER FOR A PHOTOGRAPH ALBUM

[75] Inventor: Frank B. Gunasekera, St. Cloud, Minn.

[73] Assignee: The Antioch Company, Yellow Springs, Ohio

[21] Appl. No.: 764,195

[22] Filed: Dec. 13, 1996

[51] Int. Cl.[6] ..... B42F 13/00

[52] U.S. Cl. ..... 402/79; 281/22

[58] Field of Search ..... 281/22, 38, 15.1, 281/19.1, 28, 29; 402/79, 73, 70

[56] References Cited

U.S. PATENT DOCUMENTS 1,630,487 5/1927 Harrison ..... 402/79 X 3,467,479 9/1969 Holes et al. ..... 402/13

3,485,564 12/1969 Holes et al. ..... 402/13

*Primary Examiner*—Willmon Fridie, Jr.

*Attorney, Agent, or Firm*—Biebel & French

[57] ABSTRACT

The invention comprises cover holders for use in a loose-leaf photograph album, the cover holders having greater strength, and being more economical to manufacture, than prior art cover holders for similar albums. The preferred loose-leaf photograph album includes a pair of covers enfolding a plurality of leaves. The covers and the leaves are laced together by means of straps which lace through hinge elements projecting from the leaves and through slots in the covers. The straps are frictionally held at their ends by means of the cover holders, which are positioned on opposite sides between the outer leaves and the covers.

13 Claims, 4 Drawing Sheets

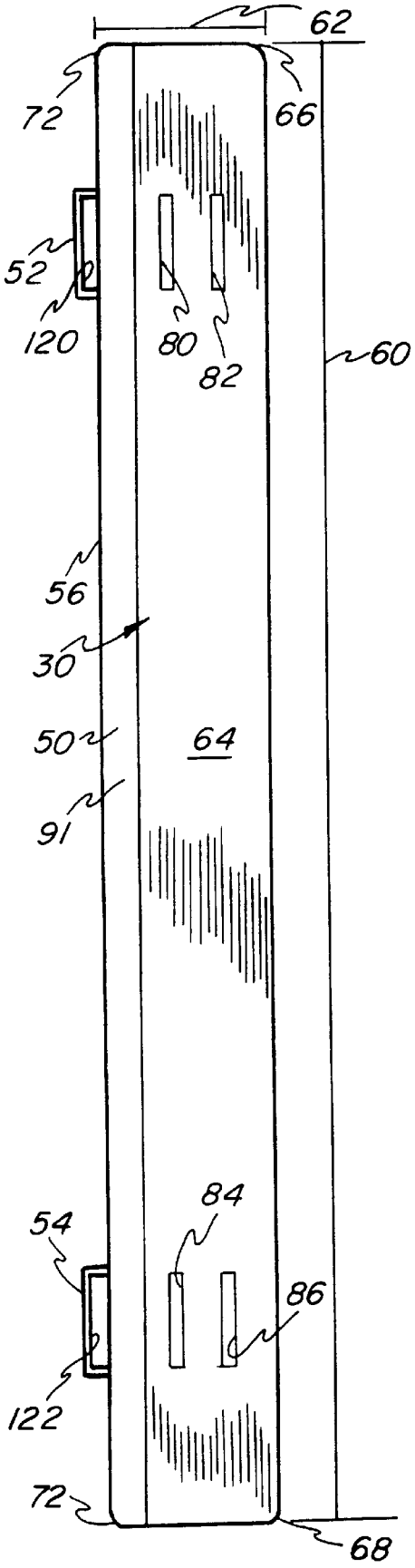
FIG-2
FIG-3
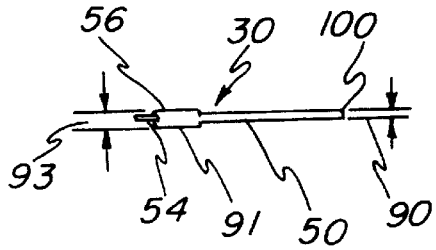

STAPLE TENSION COMPARISON FOR COVER HOLDERS
PLASTIC VS PAPER

COVER HOLDER FOR A PHOTOGRAPH ALBUM

BACKGROUND OF THE INVENTION

1. Field of the Invention

This invention relates to the field of methods and apparatus for bookbinding, and more specifically to a cover holder for a loose-leaf photograph album.

2. Description of the Related Art

A very popular style of loose-leaf photograph album is manufactured and sold under the trademark CREATIVE MEMORIES by Webway, Incorporated of St. Cloud, Minn. This style of loose-leaf photograph album includes a pair of covers enfolding a plurality of leaves. The covers and the leaves are laced together by means of straps which thread through hinge elements projecting from the leaves and through slots in the covers. The straps are frictionally held at their ends by means of cover holders positioned on opposite sides between the outer leaves and the covers. An early form of this style of album is described in more detail in U.S. Pat. No. 3,485,564 to Holes et al., issued on Dec. 23, 1969, the disclosure of which is incorporated herein by reference.

Prior art cover holders consisted of elongated cards including pairs of adjacent slots positioned along the lengths of the cards for engaging the straps. The cover holders also included closed staples mounted along the lengthwise sides of the cards by means of hinge mounting strips which provided hinge elements parallel to the hinge elements of the leaves. Examples of such cover holders are shown in U.S. Pat. No. 3,467,479 to Holes et al., the disclosure of which is incorporated herein by reference.

One drawback to the prior art cover holders was the high cost of their production. Conventionally, the cover holders, like much of the rest of the albums, were produced by hand. The staples were manually affixed to the hinge mounting strips by hand, and then the hinge mounting strips were manually folded and either glued or heat sealed over the edges of the cards.

Another drawback to the prior art cover holders was the relative weakness with which the staples were secured by the hinge mounting strip. Due to this weakness, the staples were prone to pulling out of the card holders when forces on the order of 7.5 lb (33N) were applied to the staples. Therefore, there remained a need in the art for cover holders for loose-leaf photograph albums which were more efficient to manufacture and had greater pull strengths.

SUMMARY OF THE INVENTION

This need and others are addressed by a cover holder comprising a rigid elongated body and a plurality of hinge elements projecting from a lengthwise side of the rigid body. The rigid body is formed over bound portions of the plurality of hinge elements to secure the plurality of hinge elements to the rigid elongated body. This structure provides improved pull strength as compared to prior art structures.

According to one especially preferred form, the rigid body defines a length, a width and a thickness, the length being greater than the width and the width being at least five times the thickness. The rigid body also defines pairs of slots extending through the rigid body along a direction parallel to the thickness, the slots of each pair of slots being adjacent along a direction parallel to the width of the rigid body. Each slot of each pair of slots is elongated in a direction parallel to the length of the rigid body. The hinge elements define hinge openings near each pair of slots. When the photograph album is assembled, the hinge elements align with hinge elements projecting from the leaves for receipt of the straps while the slots frictionally engage the straps to bind the leaves and the covers together.

According to another especially preferred form, the cover holder comprises a thin elongated polymeric matrix co-molded over re-entrantly bent leg portions of a plurality of metal staples to form a plurality of hinge elements, the polymeric matrix defining pairs of parallel elongated slots aligned with each of the plurality of staples for engaging a strap of the photographic album. The preferred polymeric matrix defines opposite substantially rectangular faces such that the slots extend between the opposite substantially rectangular faces. This structure is economically mass-produced by injection molding the polymeric matrix over the re-entrantly bent leg portions of the staples.

Therefore, it is one object of the invention to provide a cover holder which is more economical to produce, and in which the hinge elements have greater pull resistance, than prior art cover holders. These and other objects, features and advantages of the present invention will be described in further detail in connection with preferred embodiments of the invention shown in the accompanying drawings.

BRIEF DESCRIPTION OF THE DRAWINGS

FIG. 2 is a top plan view of a cover holder for the photograph album of FIG. 1, the bottom plan view being a mirror image thereof;

FIG. 3 is an end elevational view of the cover holder of FIG. 2, the opposite end elevational view being a mirror image thereof;

DETAILED DESCRIPTION OF THE PREFERRED EMBODIMENT

Figure 1:
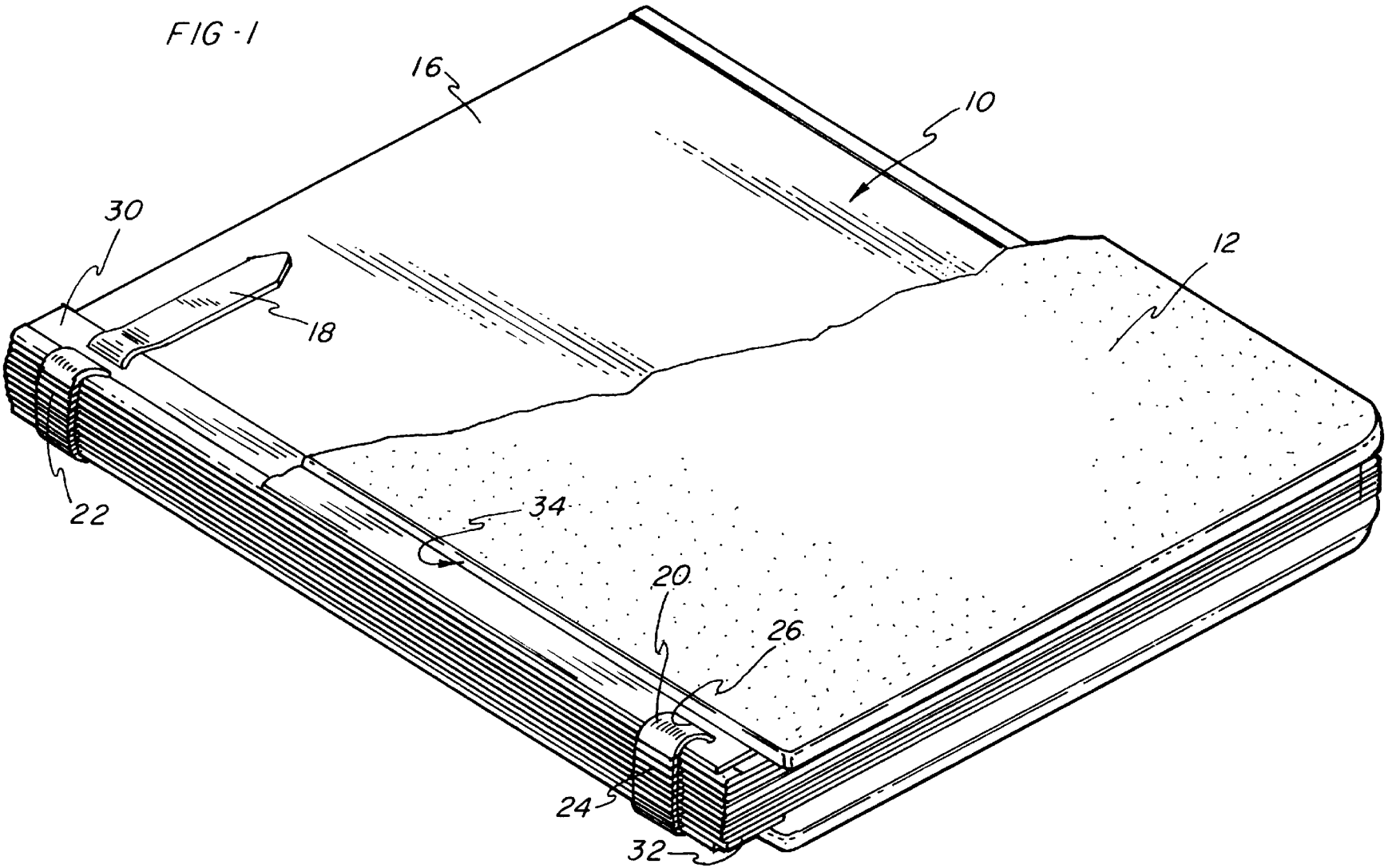
FIG. 1 is a schematic view showing the parts of a photograph album, with a portion of one cover broken away to show a cover holder according to the present invention.

As best shown in FIG. 1, a preferred loose-leaf photograph album 10 includes a pair of laminated padded covers 12, 14 enfolding a plurality of leaves 16. The covers 12, 14 and the leaves 16 are laced together by means of straps 18, 20. The straps 18, 20 are received through leaf hinge elements 22, 24, which project from the leaves 16, and through cover slots 26 (only one shown) in the covers 12, 14. The cover slots 26 on each of the covers 12, 14 bear substantially the same spacial relationship to each other that the leaf hinge elements 22 bear to the other leaf hinge elements 24 on the same leaves 16, thereby facilitating the lacing of the straps 18, 20 through the leaf hinge elements 22, 24 and the cover slots 26. The straps 18, 20 are held at either end by cover holders 30, 32 positioned immediately inside the covers 12, 14. The straps 18, 20 and the hinge elements 22, 24 are covered by a removable spine (not shown) having ends which fit into pockets 34 (only one shown) defining recesses in the covers 12, 14. The spine, the straps 18, 20 and the cover holders 30, 32 are removable to permit additional leaves (not shown) to be laced into the album 10.

As best shown in FIG. 2, a preferred cover holder 30 includes a rigid elongated body 50 and a plurality of cover holder hinge elements 52, 54 projecting from a lengthwise side 56 of the rigid elongated body 50. The rigid elongated body 50 defines a length 60 and a width 62, the length 60 being greater than the width 62. In an especially preferred form, the rigid elongated body 50 defines opposite substantially rectangular faces 64 (only one shown) with filleted corners 66, 68, 70, 72.

The rigid elongated body 50 also defines pairs of adjacent cover holder slots 80, 82 and 84, 86 extending through the rigid elongated body 50 along a direction perpendicular to directions of the length 60 and the width 62 between the substantially rectangular faces 64 (only one shown) of the rigid elongated body 50. The cover holder slots 80, 82 are adjacent to each other along a direction parallel to the width 62, and the cover holder slots 84, 86 are adjacent to each other along the same direction. Each cover holder slot 80, 82, 84, 86 is elongated in a direction parallel to the length 60. The slots 80, 82, 84, 86 are preferably dimensioned so as to frictionally engage the straps 18, 20 when the straps are laced through the slots 80, 82, 84, 86.

As best shown in FIG. 3, the rigid elongated body 50 also defines a first thickness 90 along a direction perpendicular to the directions of the length 60 (FIG. 2) and the width 62. (The cover holder slots 80, 82, 84, 86, FIG. 2, extend in the direction of this thickness 90).

In addition, the rigid elongated body 50 includes an outer edge portion 91 wherein the outer edge portion 91 defines a second thickness 93 which is greater than the first thickness 90. Preferably, the width 62 is no less than five times the thickness 93; in an especially preferred form, the width 62 is on the order of twenty times the thickness 93. This high degree of thinness assures that the covers 12, 14 (FIG. 1) will be able to close around the leaves 16 (FIG. 1) when the photograph album 10 (FIG. 1) is assembled, and that the photograph album 10 will be as thin as possible. It should be noted, however, that the degree of thinness of the rigid elongated body 50 is not critical to the invention.

Figure 4:
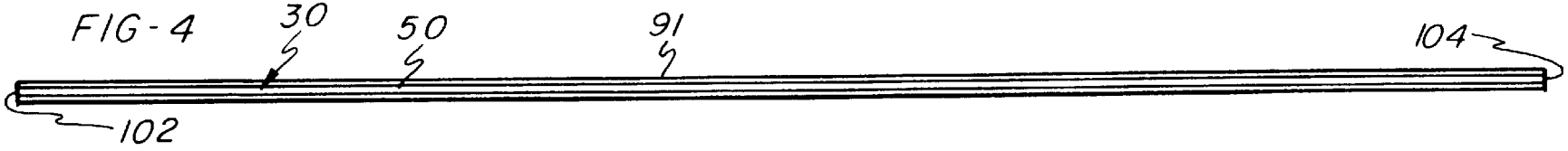
FIG. 4 is a side elevational view of the cover holder of FIG. 2.

Preferably, the lengthwise sides 56, 100 of the rigid elongated body 50 are filleted for ease of handling. Likewise, as best shown in FIG. 4, the transverse sides 102, 104 of the rigid elongated body 50 are filleted.

Figure 5:
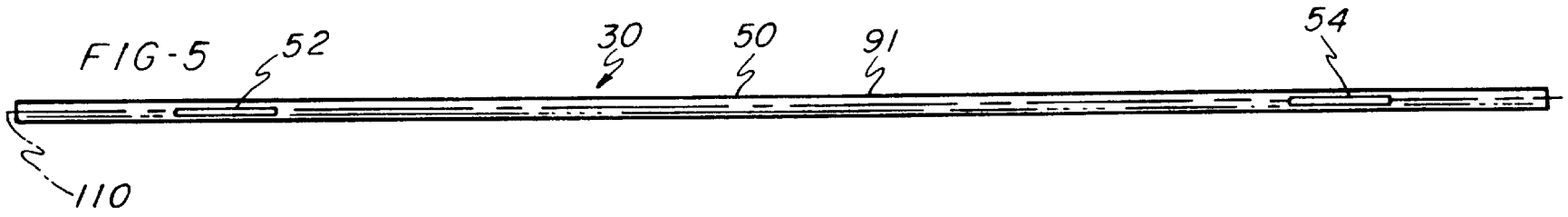
FIG. 5 is an opposite side elevational view of the cover holder of FIG. 2.

As best shown in FIG. 5, the plurality of cover holder hinge elements 52, 54 preferably lie along the lengthwise side 56 on a midplane or symmetry plane 110 bisecting the rigid elongated body 50 normally to the direction of the thickness 90. Each of the cover holder hinge elements 52, 54 defines a cover holder hinge opening 120, 122 (FIG. 2) on the midplane 110 dimensioned to receive the straps 18, 20. As shown in FIG. 1, the cover holder hinge elements 52, 54 align with the leaf hinge elements 22, 24 for receipt of the straps 18, 20. Each of the cover holder hinge elements 52, 54 is positioned near one of the pairs of adjacent cover holder slots 70, 72 and 74, 76 along the direction of the width 62 to facilitate the lacing of the straps 18, 20 through the cover holder hinge elements 52, 54 and the cover holder slots 70, 72, 74, 76.

Figure 6:
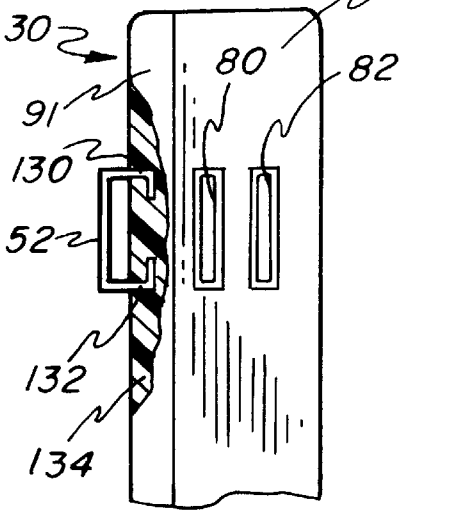
FIG. 6 is a partial plan view of the cover holder of FIG. 2, with a polymeric matrix partially broken away to show re-entrantly bent legs of a hinge element or staple secured in the polymeric matrix.

As best shown in FIG. 6, the rigid elongated body 50 preferably comprises a polymeric matrix co-molded over bound portions 130, 132 of the cover holder hinge elements 52 (only one shown in FIG. 6). In an especially preferred form, the cover holder hinge elements 52 are metal (e.g., steel) staples and the bound portions 130, 132 are re-entrantly bent (that is, bent toward each other) leg portions of the staples. As shown by the cut-away 134, the rigid elongated body 50 is formed over the bound portions 130, 132 of the cover holder hinge elements 52, 54 to firmly secure the cover holder hinge elements 52, 54 to the rigid elongated body 50. Further, the ends of the leg portions 130, 132 are located in the outer edge portion 91 wherein the additional thickness of the outer edge portion 91 provides additional strength for retaining the cover holder hinge elements 52, 54 in place on the rigid elongated body 50.

It should be noted that although the described cover holder 30 includes two cover holder hinge elements 52, 54 and respective cover holder slots 70, 72, 74, 76, additional cover holder hinge elements and cover holder slots may be provided. For example, a cover holder for cooperating with three straps may be constructed wherein an additional cover holder hinge element is located between the cover hinge elements 52, 54 along with an additional pair of cover holder slots for receiving a third strap located between the straps 18, 20.

In a process for making the cover holder 30, the rigid elongated body 50 may be formed by injection molding of a polypropylene resin, preferably polypropylene homopolymer with 1.5% polyethylene. The injection molds (not shown) comprise mold halves or members (not shown) which close to define a mold cavity (not shown) in the shape of the rigid elongated body 50. Preferably, the mold members are split along a plane corresponding to the midplane 110 (FIG. 5) of the rigid elongated body 50. Positioning recesses (not shown) are provided along a side of the mold cavity corresponding to the lengthwise side 56 (FIG. 5) defining apertures (not shown) through which the bound portions 130, 132 extend into the mold cavity.

The cover holder hinge elements 52, 54 are formed prior to the injection molding step by cutting and bending steel wire to the desired shape. Next, the cover holder hinge elements 52, 54 are positioned, either manually or through automated transport means, in the positioning recesses (not shown) of one of the mold members (not shown) such that the bound portions 130, 132 extend into the mold cavity (not shown). Resin is injected into the mold under pressure through a gate spaced from the positioning recesses in a direction transverse to the plane along which the mold is broken (that is, transverse to the planes of the opposite substantially rectangular faces 64, FIG. 2). The pressurized resin surrounds the bound portions 130, 132 of the cover holder hinge elements 52, 54 and cures to form an intimate bond between the rigid elongated body 50 and the cover holder hinge elements 52, 54.

Figure 7:
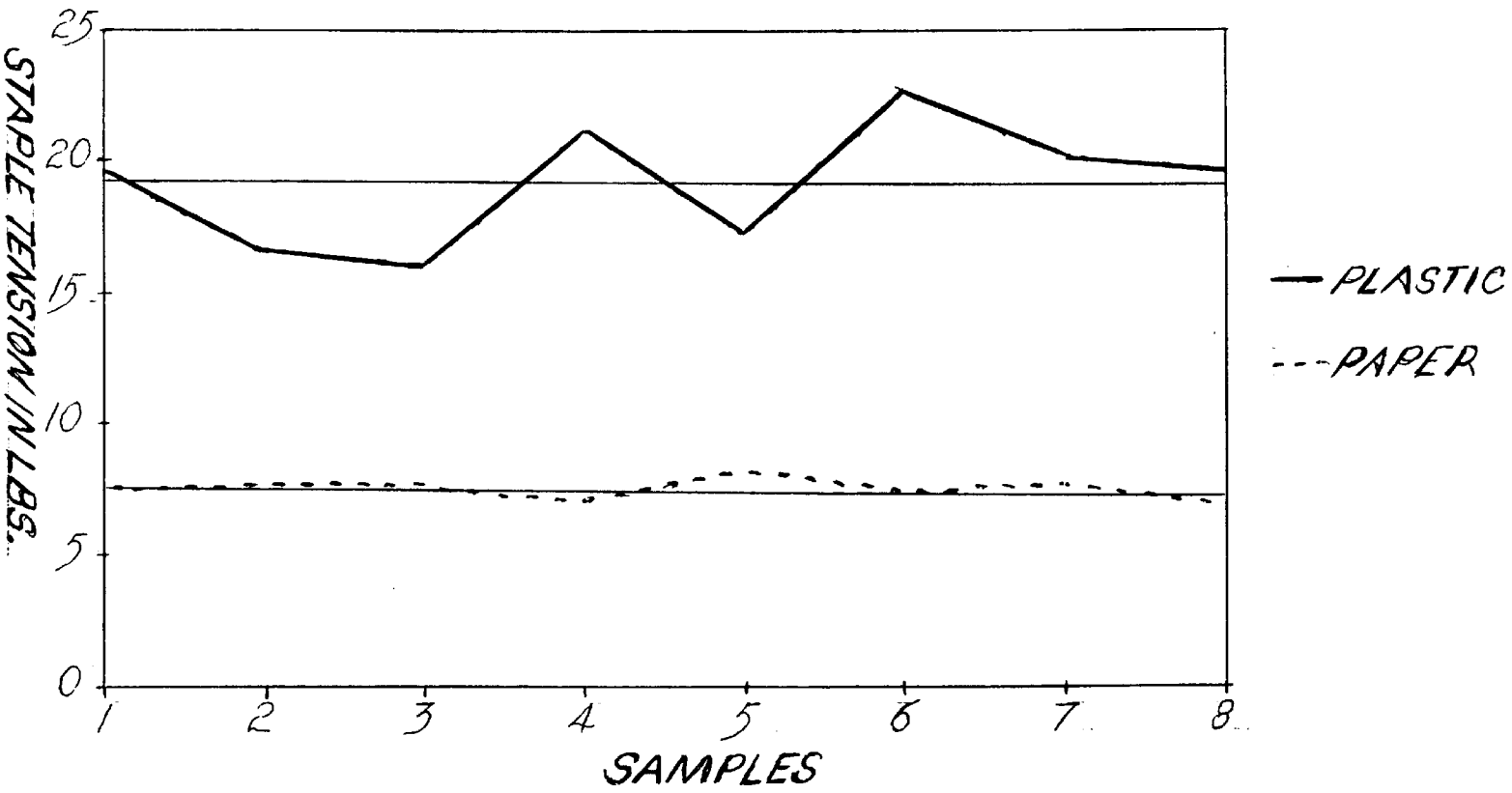
FIG. 7 is a graph comparing the staple tension capacities of prior cover holders and cover holders according to the present invention.

The pull strength of this bond as compared with the pull strength of hinge elements in prior art cover holders is illustrated in FIG. 7. Eight sample cover holders according to the invention, and eight sample prior art cover holders in which the hinge elements were stapled secured to cards by means of hinge mounting strips glued to the cards, were tested to determine the force (that is, the "pull strength" or "staple tension") at which the hinge elements pulled off from the cover holders. As shown in FIG. 7, the average pull strength or staple tension 140 of the prior art samples was 7.43 lb. (33N), while the average pull strength 142 of the cover holder 30 of the invention was 19.13 lb. (85N). The average pull strength of the cover holder hinge elements 52, 54 of the preferred cover holder 30 of the present invention was over two-and-one-half times the pull strength of the prior art hinge elements.

Therefore, the cover holder 30 of the present invention possesses significantly greater pull strength than cover holders known in the prior art. At the same time, the injection co-molding process for mass-producing the preferred cover holder 30 is more economical than the labor-intensive techniques commonly used in the past. The present invention contemplates embodiments having different geometries and composed of different materials consistent with these objects and the function of the cover holder 30 in the photograph album 10. Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. A cover holder for a loose-leaf photograph album comprising:

a rigid elongated body including opposing face surfaces and lengthwise extending side edges;

slots extending through the rigid elongated body between the opposing face surfaces; and hinge elements projecting from one of the side edges of the rigid elongated body to define hinge openings aligned with the slots;

the rigid elongated body being formed of a polymer molded over bound portions of the hinge elements to secure the hinge elements to the rigid elongated body.

2. The cover holder as recited in claim 1 wherein the hinge elements are metallic.

3. The cover holder as recited in claim 1 wherein the hinge elements are staples and the bound portions of the hinge elements comprise two leg portions of the staples, each leg portion including an end which is bent inwardly toward the other leg portion.

4. A cover holder for a photograph album comprising:

a rigid body defining a length, a width and a thickness, the length being greater than the width and the width being at least five times the thickness;

pairs of slots extending through the rigid body along a direction parallel to the thickness, the slots of each pair of slots being adjacent along a direction parallel to the width of the rigid body, and each slot of each pair of slots being elongated in a direction parallel to the length of the rigid body;

hinge elements projecting from a lengthwise side of the rigid body to define hinge openings near the pair of slots;

the rigid body being formed of a polymer molded over bound portions of the hinge elements to secure the hinge elements to the rigid body.

5. The cover holder as recited in claim 4 wherein the hinge elements are metallic.

6. The cover holder as recited in claim 4 wherein the hinge elements are staples and the bound portions of the hinge elements comprise two leg portions of the staples, each leg portion including an end which is bent inwardly toward the other leg portion.

7. A cover holder for a loose-leaf photograph album comprising a thin elongated polymeric matrix co-molded over leg portions of a plurality of metal staples to form a plurality of hinge elements, each of the staples including two leg portions and each leg portion including an end which is bent inwardly toward the other leg portion, and pairs of parallel elongated slots extending through the polymeric matrix and each pair of slots being aligned with each of the plurality of staples for engaging a strap of the photographic album.

8. The cover holder as recited in claim 7 wherein the thin elongated polymeric matrix defines opposite substantially rectangular faces and wherein each slot of the plurality of pairs of elongated slots extends between the opposite substantially rectangular faces.

9. A kit for assembling a loose-leaf photograph album comprising:

at least one flexible strap;

a plurality of leaves, each leaf of the plurality of leaves defining a plurality of projecting leaf hinge elements dimensioned to receive the at least one flexible strap;

a pair of covers defining cover slots positioned and dimensioned to receive the at least one flexible strap to bind the pair of covers to the plurality of leaves; and a pair of cover holders for placement between the plurality of leaves and each cover of the pair of covers, each cover holder of the pair of cover holders including a rigid elongated body and a plurality of hinge elements projecting from a lengthwise side of the rigid elongated body for alignment with the leaf hinge elements and receipt of the at least one strap, and including pairs of adjacent slots extending through the rigid elongated body for receiving and frictionally engaging the at least one strap.

10. The cover holder as recited in claim 9 wherein the rigid elongated body is formed from a polymeric matrix co-molded over bound portions of the hinge elements.

11. The cover holder as recited in claim 9 wherein the plurality of hinge elements are metallic.

12. The cover holder as recited in claim 9 wherein the plurality of hinge elements are staples including bound portions located within the rigid elongated body, and the bound portions of the plurality of hinge elements comprise two leg portions of the staples, each leg portion including an end which is bent inwardly toward the other leg portion.

13. A kit for assembling a loose-leaf photographic album comprising:

at least one flexible strap;

a plurality of leaves, each leaf of the plurality of leaves defining a plurality of projecting leaf hinge elements suitably dimensioned to receive the at least one flexible strap;

a pair of covers defining cover slots suitably dimensioned to receive the at least one flexible strap, the cover slots bearing substantially the same spacial relationship to each other that a leaf hinge element of the plurality of hinge elements on one leaf of the plurality of leaves bears to another leaf hinge element of the plurality of hinge elements on that one leaf;

a pair of cover holders for placement between the plurality of leaves and the pair of covers, each cover holder of the pair of cover holders including a thin elongated polymeric matrix co-molded over leg portions of a plurality of metal staples to form a plurality of cover holder hinge elements for alignment with the leaf hinge elements and receipt of the at least one strap, each of the staples including two leg portions and each leg portion including an end which is bent inwardly toward the other leg portion; and pairs of parallel elongated slots extending through the polymeric matrix and positioned near each of the plurality of staples for frictionally engaging the strap.

* * * * *